US009084929B2

(12) United States Patent
Martin

(10) Patent No.: US 9,084,929 B2
(45) Date of Patent: Jul. 21, 2015

(54) CRASHING GAME

(71) Applicant: Bradley J. Martin, Virginia Beach, VA (US)

(72) Inventor: Bradley J. Martin, Virginia Beach, VA (US)

( * ) Notice: Subject to any disclaimer, the term of this patent is extended or adjusted under 35 U.S.C. 154(b) by 0 days.

(21) Appl. No.: 14/451,216

(22) Filed: Aug. 4, 2014

(65) Prior Publication Data

US 2015/0050860 A1 Feb. 19, 2015

Related U.S. Application Data

(60) Provisional application No. 61/865,554, filed on Aug. 13, 2013.

(51) Int. Cl.

| | |
|---|---|
| ***A63H 33/00*** | (2006.01) |
| ***A63F 9/00*** | (2006.01) |
| ***A63F 7/00*** | (2006.01) |
| ***A63H 33/08*** | (2006.01) |
| *A63F 7/36* | (2006.01) |

(52) U.S. Cl.

CPC ..... *A63F 9/0076* (2013.01); *A63F 7/0017* (2013.01); *A63H 33/086* (2013.01); *A63F 2007/3677* (2013.01)

(58) Field of Classification Search

USPC ..... 446/4, 6, 85; 434/273, 300, 302

See application file for complete search history.

(56) References Cited

U.S. PATENT DOCUMENTS

| | | | | |
|---|---|---|---|---|
| 276,539 | A * | 4/1883 | Reed | 446/4 |
| 2,457,653 | A * | 12/1948 | Froelich | 446/4 |
| 2,985,451 | A * | 5/1961 | Sims | 273/446 |
| 3,649,018 | A * | 3/1972 | Beam | 273/386 |
| 4,105,210 | A * | 8/1978 | Jones et al. | 273/126 R |
| 4,573,944 | A * | 3/1986 | Crow et al. | 446/465 |
| 5,295,694 | A * | 3/1994 | Levin | 273/447 |
| 5,397,260 | A * | 3/1995 | Tilbor et al. | 446/4 |
| 5,601,433 | A * | 2/1997 | Potter | 434/130 |
| 6,149,485 | A * | 11/2000 | Christiansen | 446/4 |
| 6,609,715 | B2 * | 8/2003 | Anthony | 273/447 |
| 7,032,452 | B1 * | 4/2006 | Peng et al. | 73/663 |
| 9,011,157 | B2 * | 4/2015 | Gunasekaran | 434/258 |

* cited by examiner

*Primary Examiner* — Kurt Fernstrom

(74) *Attorney, Agent, or Firm* — Snell & Wilmer LLP

(57) ABSTRACT

A children's building block crashing game and a method of conducting the building block crashing game in which building block assembly structures are crashed upon collision. Players assemble personally designed or preconfigured building block sets which meet the game restrictions on size and thickness, and then crash them together by sliding the structures down a low friction mat through a protective plastic shield. The player with the last piece remaining in the tunnel wins the round.

20 Claims, 15 Drawing Sheets

CRASHING GAME

CROSS-REFERENCE TO RELATED APPLICATIONS

The present application claims the benefit and priority of U.S. Provisional Application No. 61/865,554, filed on Aug. 13, 2013, entitled "CRASHING GAME." Thus, the entire disclosure of U.S. Provisional Application No. 61/865,554 is hereby incorporated by reference herein.

BACKGROUND

1. Field

The present invention relates generally to children's games. More particularly, the present invention relates to games involving buildable structures having smaller interlocking blocks.

2. Description of the Related Art

Building block sets, such as LEGOs®, provide children and young adults with a fun and innovative way to express their imagination through various combinations of the smaller pieces or parts. Smaller interlocking blocks can be configured to fit together in numerous different ways, allowing individuals to create their own unique designs and express their creativity.

Some manufacturers even sell pre-configured sets of building blocks or LEGOs®, where the smaller interlocking blocks fit together to form a specific shape or function, such as a space ship or a fortress. These designs allow the individual to make more elaborate constructions than may have been possible with the standard all-purpose building block sets.

Unfortunately, even with these more elaborate structures, eventually an individual will lose interest in the building blocks, as they have exhausted their potential combinations and desire a more active extracurricular activity. Thus, there is a need for a system that combines the imagination of a building block set with the action of a competitive game.

SUMMARY

A system and method for crashing building block assembly structures together in a safe and fun environment is disclosed. In one embodiment, the system may include two or more building block assembly structures assembled by the user and capable of sliding across a surface, a protective plastic shield that is easily assembled and designed to contain any smaller pieces or parts that may be ejected during collision of the structures, and a mat for sliding the structures across. Players can create building block assembly structures from their own designs or from pre-configured sets and compete against each other individually or in teams, to see whose structure survives the crashes. The protective plastic shield helps keep pieces or parts from flying away from the crashing structures and damaging walls or injuring players. The mat provides a low friction surface to slide the structures across. The individual structures themselves can be configured strategically to combat the opponent's structure, altering the reach, size, speed, and spinning capability to win the round. Restrictions on the number of pieces or parts and thickness of each structure ensure that each player is competing on even grounds.

In one embodiment, a building block crashing game is provided for crashing building block assembly structures together. The building block crashing game includes a first building block assembly structure including a first building block part removably connected to a second building block part. The first building block part and the second building block part are configured to be removable from one another when a collision force applied during collision with another building block assembly structure is sufficient to remove the first building block part and the second building block part from one another. The building block crashing game further includes a second building block assembly structure including a third building block part removably connected to a fourth building block part. The third building block part and the fourth building block part are configured to be removable from one another upon a collision force applied during collision with another building block assembly structure that is sufficient to remove the third building block part and the fourth building block part from one another. A sliding surface is provided for sliding the first building block assembly structure and the second building block assembly structure towards each other on the mat in order to cause collision of the first building block assembly structure and the second building block assembly. Furthermore, a protective shield is provided having a portion positioned on or around the mat for containing the first building block assembly structure and the second building block assembly structure after the collision.

In one embodiment, the protective shield includes two vertical parallel side walls positioned on or around the mat, and perpendicular to a surface upon which the mat is placed. The protective shield further includes a horizontal wall positioned parallel to the surface upon which the mat is placed, and connecting the two vertical parallel side walls such that the protective shield forms a protective tunnel. In one embodiment, the protective shield is configured to connect lengthwise to another protective shield via connectors, thereby extending a length of the protective tunnel.

In one embodiment, one of the structures may include a pre-configured set of smaller pieces or parts that can form the shape of a "flying wing." The flying wing structure may include thicker inner building blocks covered by thinner outer building blocks which are shaped to look like the wings, nose, and tail of an aircraft.

In one embodiment, one of the structures may include a pre-configured set of smaller pieces or parts that can form the shape of a two-sided spike. The two-sided spike structure may include thicker inner building blocks covered by thinner outer building blocks which are shaped to look like two protruding spikes extending from a more rigid rectangular structure.

In one embodiment, one of the structures may include a pre-configured set of smaller pieces or parts that can form the shape of a battering ram. The battering ram structure may include thicker inner building blocks covered by thinner outer building blocks which are shaped to look like an elongated battering ram extending from a more rigid rectangular structure.

In one embodiment, one of the structures may include a pre-configured set of smaller pieces or parts that can form the shape of a ramp. The ramp structure may include thicker inner building blocks covered by thinner outer building blocks which are shaped to look like an elongated rectangular structure with slanted side walls resembling a ramp.

In one embodiment, one of the structures may include a pre-configured set of smaller pieces or parts that can form the shape of a rectangular block. The block assembly may include thicker inner building blocks covered by thinner outer building blocks which are shaped to look like an elongated rectangular structure.

In one embodiment, one of the structures may include a pre-configured set of smaller pieces or parts that can form the shape of a porcupine. The porcupine structure may include thicker inner building blocks covered by thinner outer building blocks which are shaped to look like a long rectangular structure with protruding spikes around the edges, for added attack during competitions.

In one embodiment, one of the structures may include a pre-configured set of smaller pieces or parts that can form the shape of a catamaran vessel. The catamaran structure may include thicker inner building blocks covered by thinner outer building blocks which are shaped to look like two rectangular structures connected together by a central rectangular structure, altogether resembling a traditional catamaran vessel.

In one embodiment, one of the structures may include a pre-configured set of smaller pieces or parts that can be a combination of a set of rigid square edges and angled edges to form a more efficient crushing structure during competitions. The crusher structure may include thicker inner building blocks covered by thinner outer building blocks for added stability during competitions.

In one embodiment, one of the structures may include a pre-configured set of smaller pieces or parts that can form the shape of a spinning top, or spinner. The spinner structure may include thicker inner building blocks covered by thinner outer building blocks for added stability, a central rigid rectangular area for added rigidity, and protruding arms on each corner for added reach during competitions.

In one embodiment, a method for crashing building block assembly structures together includes providing a first building block assembly structure including a first plurality of removably connected building block parts. A second building block assembly structure is provided which includes a second plurality of removably connected building block parts. A mat is provided for allowing sliding of building block assemblies. A protective shield is provided having a part positioned on or around the mat, the protective shield and the mat forming a tunnel. The first building block assembly structure and the second building structure are slid towards each other on the mat and within the protective shield in order to cause collision of the first building block assembly structure and the second building block assembly structure and to cause removal or disassembly of the first plurality of removably connected building block parts and removal or disassembly of the second plurality of removably connected building block parts.

In one embodiment, the steps of providing the first building block assembly structure and providing the second building block assembly structure are based on a predetermined guideline that includes a restriction on at least one of a shape, a size, or a number of projections of the first building block assembly structure or the second building block assembly structure.

In one embodiment, the step of sliding the first building block assembly structure and the second building structure towards each other on the mat and within the protective shield is performed such that at least one of the first building block assembly structure and the second building block assembly structure spin before collision.

In one embodiment, the manufacturer's box provides an easy storage unit for the entire system, including the protective plastic shield, mat, and individual building block assembly structures.

BRIEF DESCRIPTION OF THE DRAWINGS

Other systems, methods, features, and advantages of the present invention will be or will become apparent to one with skill in the art upon examination of the following figures and detailed description. It is intended that all such additional systems, methods, features, and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Figure 1A:
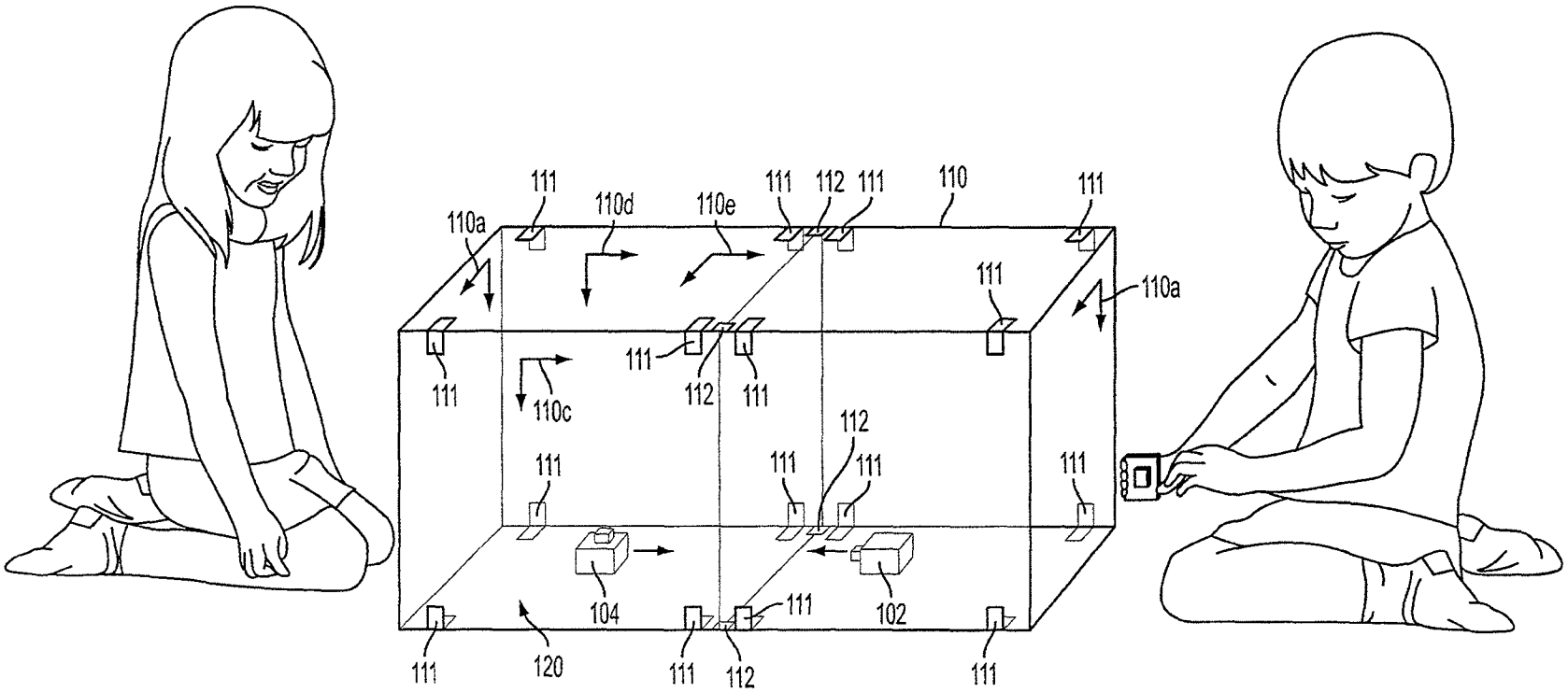
FIG. 1A depicts two players competing in the crashing game by sliding their building block assembly structures towards each other inside the protective plastic shield according to an embodiment of the present invention.

In one embodiment, as shown in FIG. 1A, a crashing game includes a protective plastic shield 110, a sliding mat 120, and at least two building block assembly structures 102 and 104 that players can crash together.

The protective plastic shield 110 is made of at least 3 connecting plastic walls, having at least a top wall 110*e*, and two side walls 110*d* and 110*c* fixed together by connecting joints 111. Multiple shield blocks can be linked together to form longer structures for competitions using the connections joints 112. The protective plastic shield 110 opens up to the user at each end 110*a*, allowing a player to engage their building block assembly structure from their specific side of the system. The protective plastic shield 110 can be between 1 and 3 feet in height, allowing for different size competition arenas depending on the age of the player and size of the building block assembly structure.

Those of ordinary skill in the art would appreciate that other impact resistant materials can be utilized to form the walls of the protective plastic shield, and that the length, width, and height of the shield can be adjusted to fit the desired player and building block size. The material and size is selected such that it safely contains any pieces or parts that may be ejected from the building block assembly structures during gameplay.

To help facilitate the crashing game, a low friction sliding mat 120 provides a smooth and safe surface to slide the building block assembly structures across. The mat 120 extends from each side of the protective plastic shield 110, allowing effective sliding throughout the shield apparatus. A "mat" as used herein may refer to any low-friction surface upon which building block assembly structures can be slid.

The building block assembly structures, shown as 102 and 104 in FIG. 1A, can be slid by a player on each end of the system, with the intent of crashing the player's building block assembly structure with the opponent's building block assembly structure and thereby causing the opponents structure to removed or disassembled. The building block assembly structures described herein have "removably connected" building block parts. "Removably connected" building block parts as used herein refers to building block parts that are connected, attached, snapped in place to form a connection or assembled to one another, but can be disassembled, detached, snapped away from one another, disconnected or other means of removal, by a user removing them or due to collision with other building blocks. The player with the last remaining piece inside the protective plastic shield 110 wins the round.

The building block assembly structures 102 and 104 may include a plurality of blocks, each having an array of cylindrical or tubular projections extending from one surface thereof and a like array of socket-like receptacles in the opposite surface for stackable interconnection. A person of ordinary skill in the art would appreciate that other configurations of interconnecting blocks could be utilized, providing variances in the shape of the projections and receptacles, as well as variances in the shape and size of the interconnecting blocks (which can take any shape that is desired, as long as the block has at least a single projection or receptacle to fit together with other blocks).

Figure 1B:
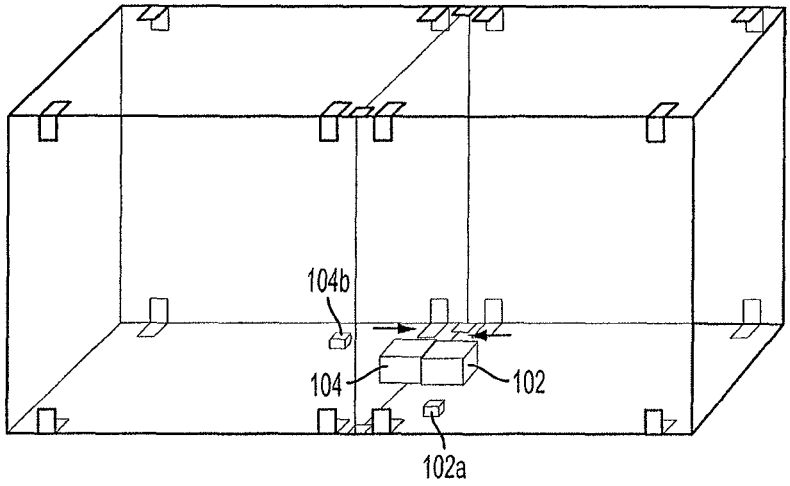
FIG. 1B depicts two of the structures colliding with each other and losing a piece according to an embodiment of the present invention.

FIG. 1B demonstrates a situation where the two competing building block assembly structures 102 and 104 have been crashed together, resulting in individual smaller building block pieces or parts 102*a* and 104*b* falling off.

Figure 2B:
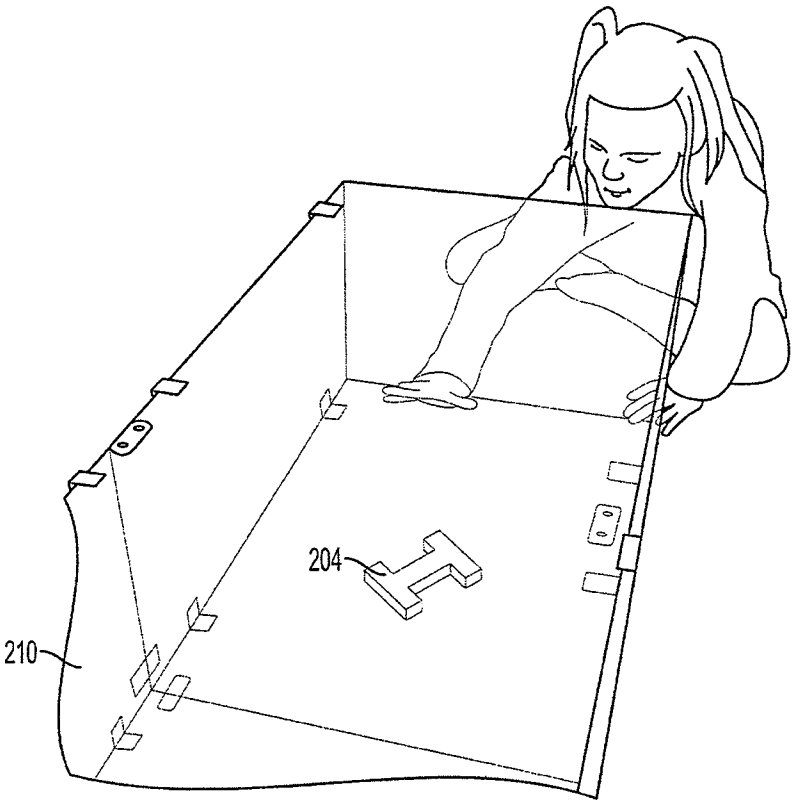
FIGS. 2A and 2B show pictures of children competing in the crashing game according to an embodiment of the present invention.
Figure 2A:
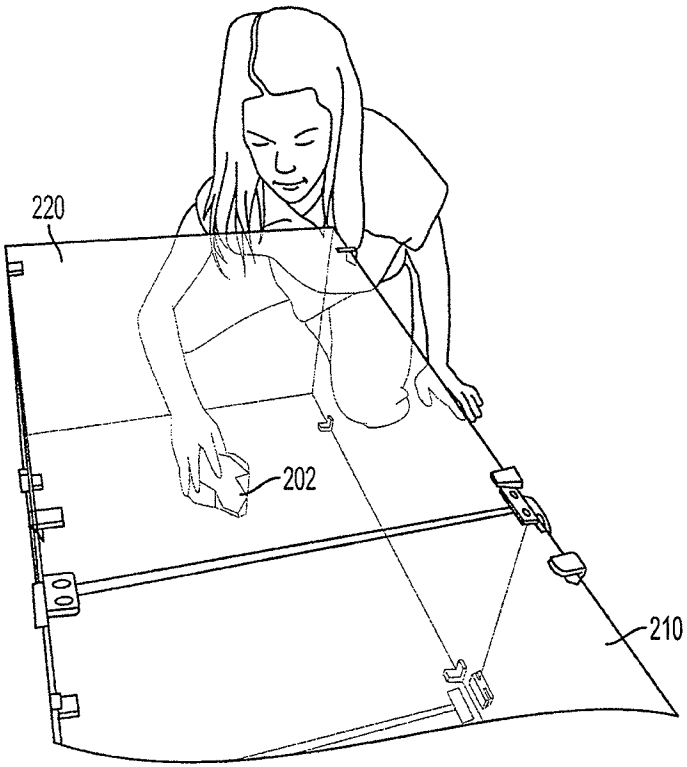

Similarly, FIGS. 2A and 2B depict two players competing in the crashing game, with an assembled protective plastic shield 210 and corresponding building block assembly structures 202 and 204. The crashing game box, which sits in the background of these figures, can also act as a holding vessel for the building blocks and protective plastic shield, when the system is not in use.

Figure 3:
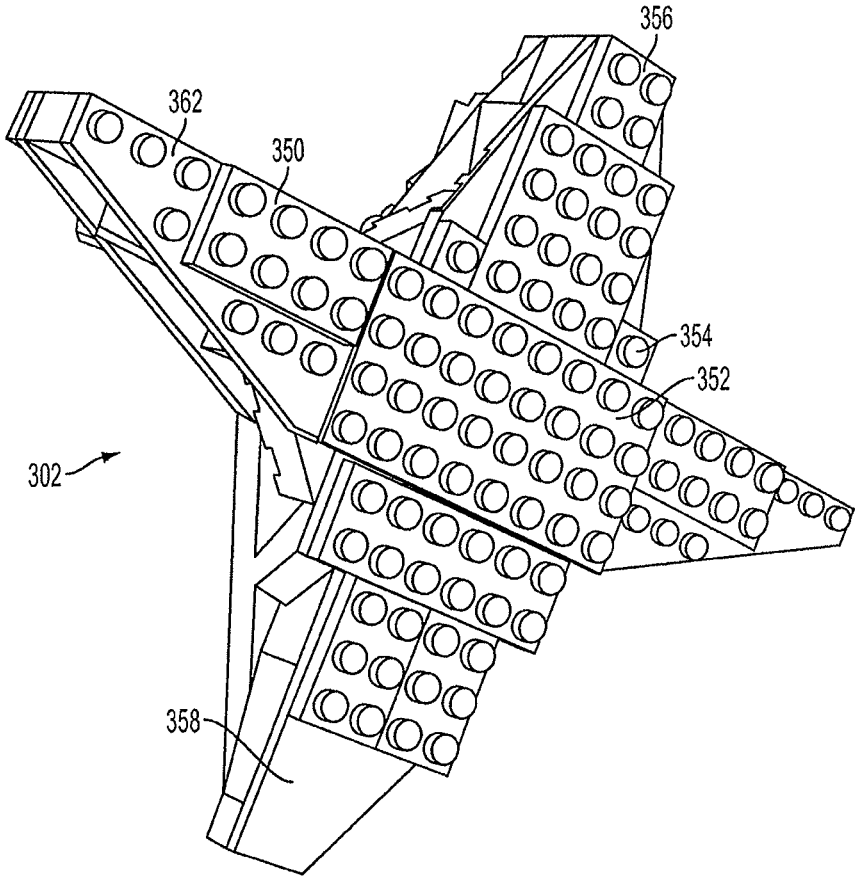
FIG. 3 depicts a flying wing building block assembly structure according to an embodiment of the present invention.

In one embodiment, as depicted in FIG. 3, a building block assembly structure 302 may include a pre-configured set of smaller blocks that can form the shape of a flying wing. The flying wing structure may be constructed using a combination of standard rectangular building blocks with varying thickness, lengths, and widths, such as block 350 containing 2×4 projections, block 352 containing 4×8 projections, block 354 containing a single projection, and block 356 containing 2×2 projections. Thinner building blocks can be placed over the thicker building blocks, to add more stability to the structure. In addition to the standard building block sizes, the flying wing may include a specifically configured Nose Piece block 358, tail blocks 362, and wing blocks 364.

Figure 4:
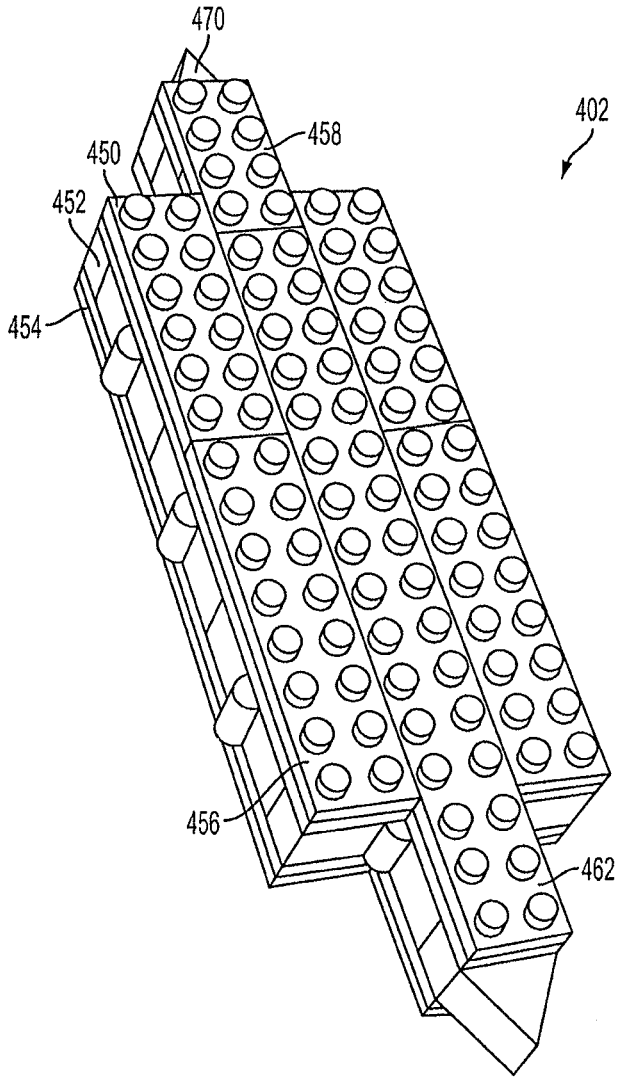
FIG. 4 depicts a two-sided spike building block assembly structure according to an embodiment of the present invention.

In one embodiment, as depicted in FIG. 4, a building block assembly structure 402 may include a pre-configured set of smaller blocks that can form the shape of a two-sided spike. The two-sided spike structure may be constructed using a combination of standard rectangular building blocks with varying thickness, lengths, and widths, such as block 450 containing 2'6 projections, thick inner blocks 452 for added stability, thinner bottom blocks 454 for holding the structure together, a block 456 containing 2×8 projections, a block 458 containing 2×4 projections, and a block 462 containing 2×16 projections. In addition to the standard building blocks, the two-sided spike may include two protruding spikes 470, which allow this embodiment to apply a more focused force during gameplay.

Figure 5:
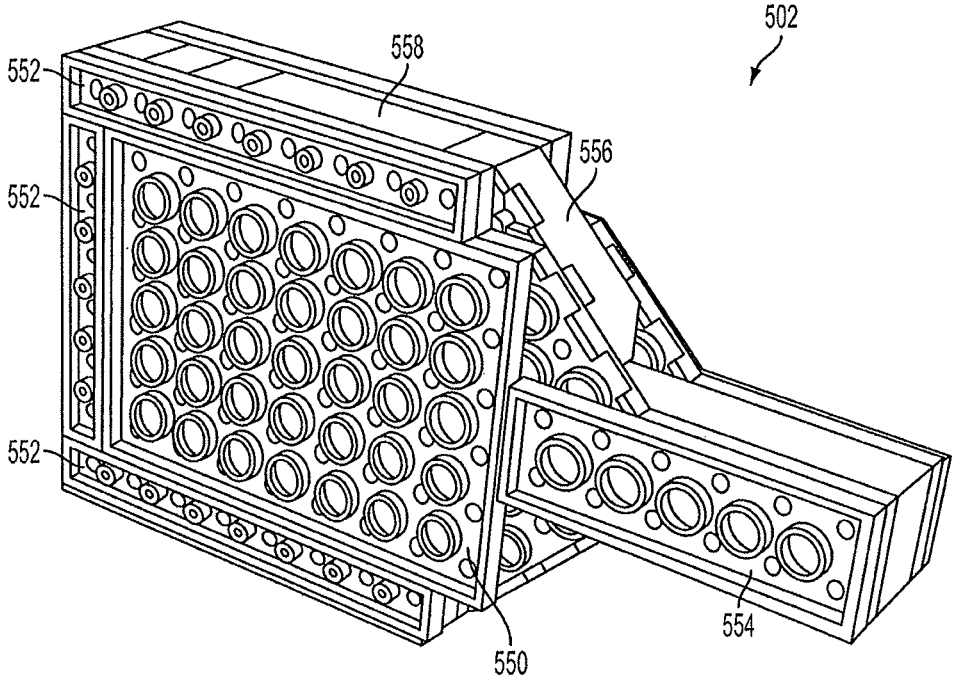
FIG. 5 depicts a battering ram building block assembly structure according to an embodiment of the present invention.

In one embodiment, as seen in FIG. 5, one of the structures may include a pre-configured set of smaller pieces or parts that can form the shape of a battering ram. The battering ram structure 502 may be constructed using a combination of standard rectangular building blocks with varying thickness, lengths, and widths, such as a large central block 550 containing 5×7 projections, stabilizing narrow side blocks 552 containing 1×7 projections, long ram like blocks 554 containing 1×5 projections, a wedge shaped block 556 allowing the long ram to connect to the base of the structure, and thick inner blocks 558 for providing rigidity and weight to the structure.

Figure 6:
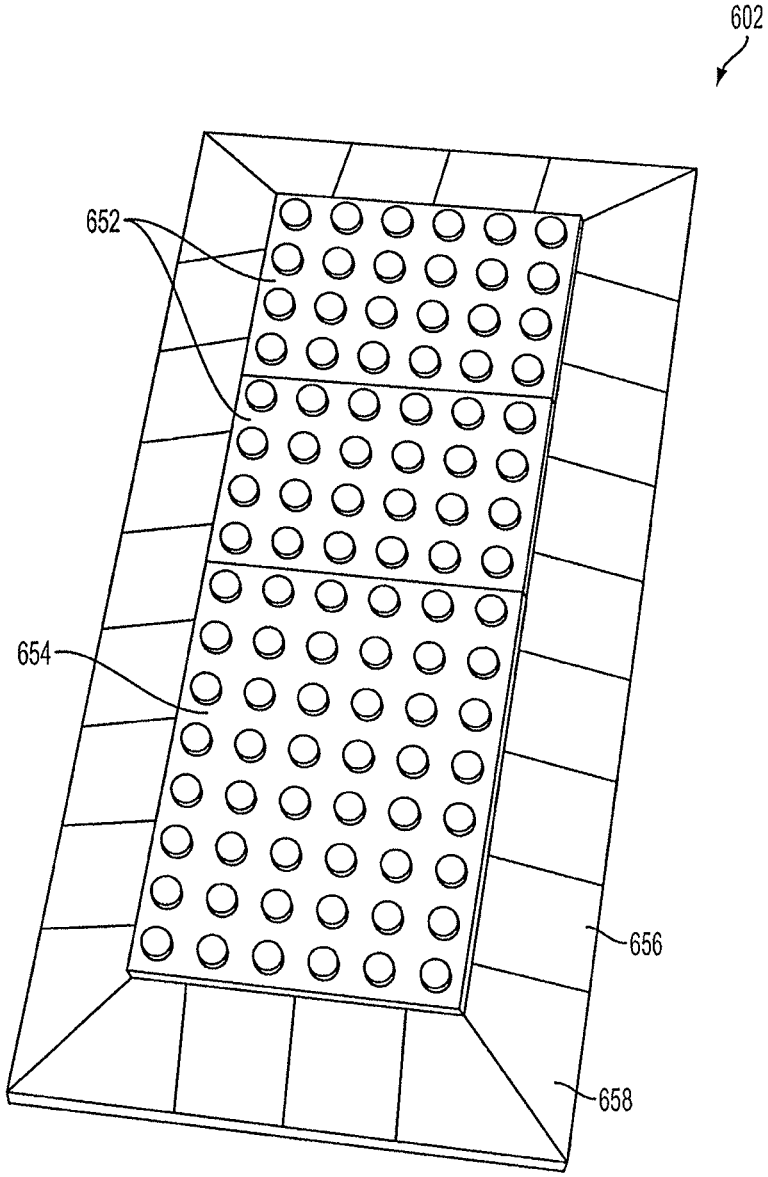
FIG. 6 depicts the ramp building block assembly structure according to an embodiment of the present invention.

In one embodiment, as seen in FIG. 6, one of the structures may include a pre-configured set of smaller pieces or parts that can form the shape of a ramp. The ramp structure 602 may be constructed using a combination of standard rectangular building blocks with varying thickness, lengths, and widths, such as large central blocks 652 and 654, which may contain 4×6 and 6×8 projections respectively. The structure may also contain specially configured ramp blocks 656 and 658, which have standard receptacles on the bottom, while possessing a smooth slanted edge on the top to help form the shape of a ramp. As per the previous structures, the ramp structure 602 may possess a layer of thick inner building blocks to help provide weight and rigidity to the structure.

Figure 7:
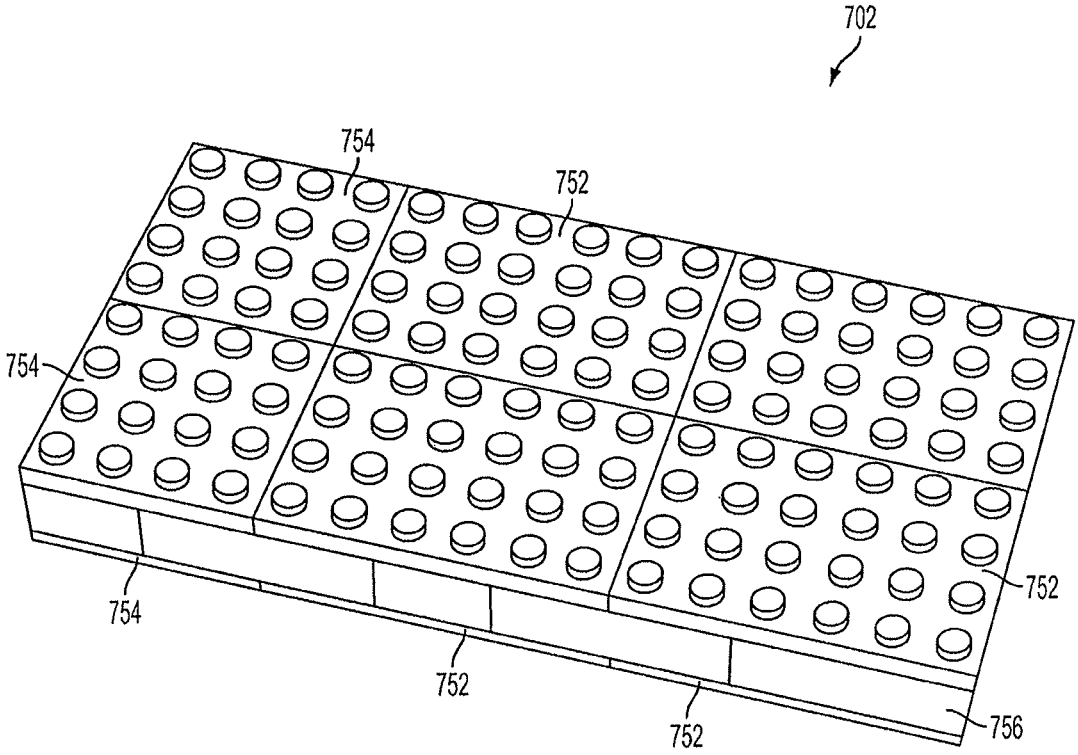
FIG. 7 depicts the block building block assembly structure according to an embodiment of the present invention.

In one embodiment, as seen in FIG. 7, one of the structures may include a pre-configured set of smaller pieces or parts that can form the shape of a rectangular block. The block assembly 702 may be constructed using a combination of standard rectangular building blocks with varying thickness, lengths, and widths, such as blocks 752 containing 4×6 projections, blocks 754 containing 4×4 projections, and thicker inner blocks 756 providing added weight and rigidity to the structure. The block assembly 702 is simplistic in nature, but allows the player to focus on a strategy of having less protruding pieces or parts that may fall off, emphasizing defense over offense.

Figure 8:
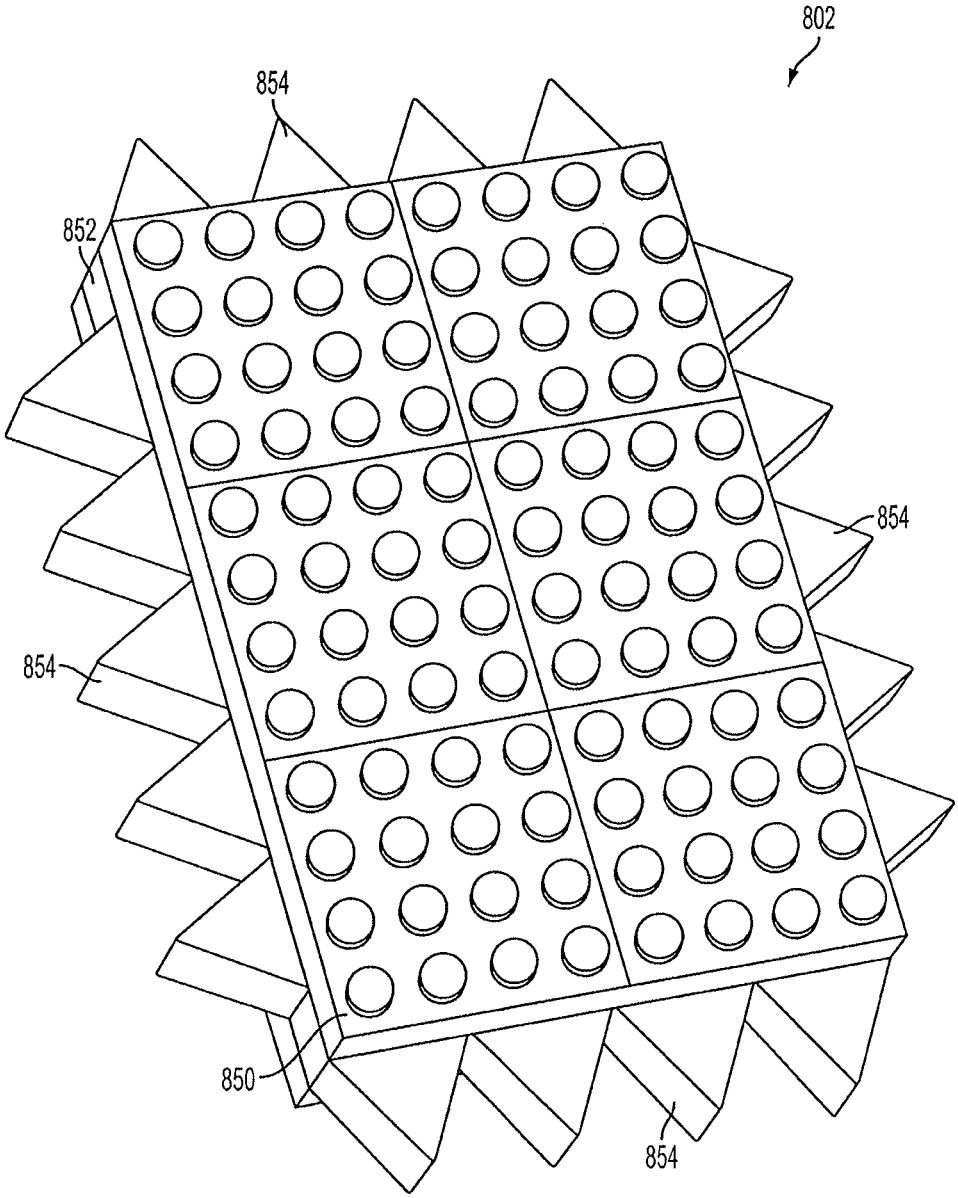
FIG. 8 depicts the porcupine building block assembly structure according to an embodiment of the present invention.

In one embodiment, as seen in FIG. 8, one of the structures may include a pre-configured set of smaller pieces or parts that can form the shape of a porcupine. The porcupine structure 802 may be constructed using a combination of standard rectangular building blocks with varying thickness, lengths, and widths, such as blocks 850 containing 4×4 projections, thicker inner blocks 852 providing weight and rigidity to the structure, and specially configured spike blocks 854 to provide multiple angles of attack during competitions.

Figure 9:
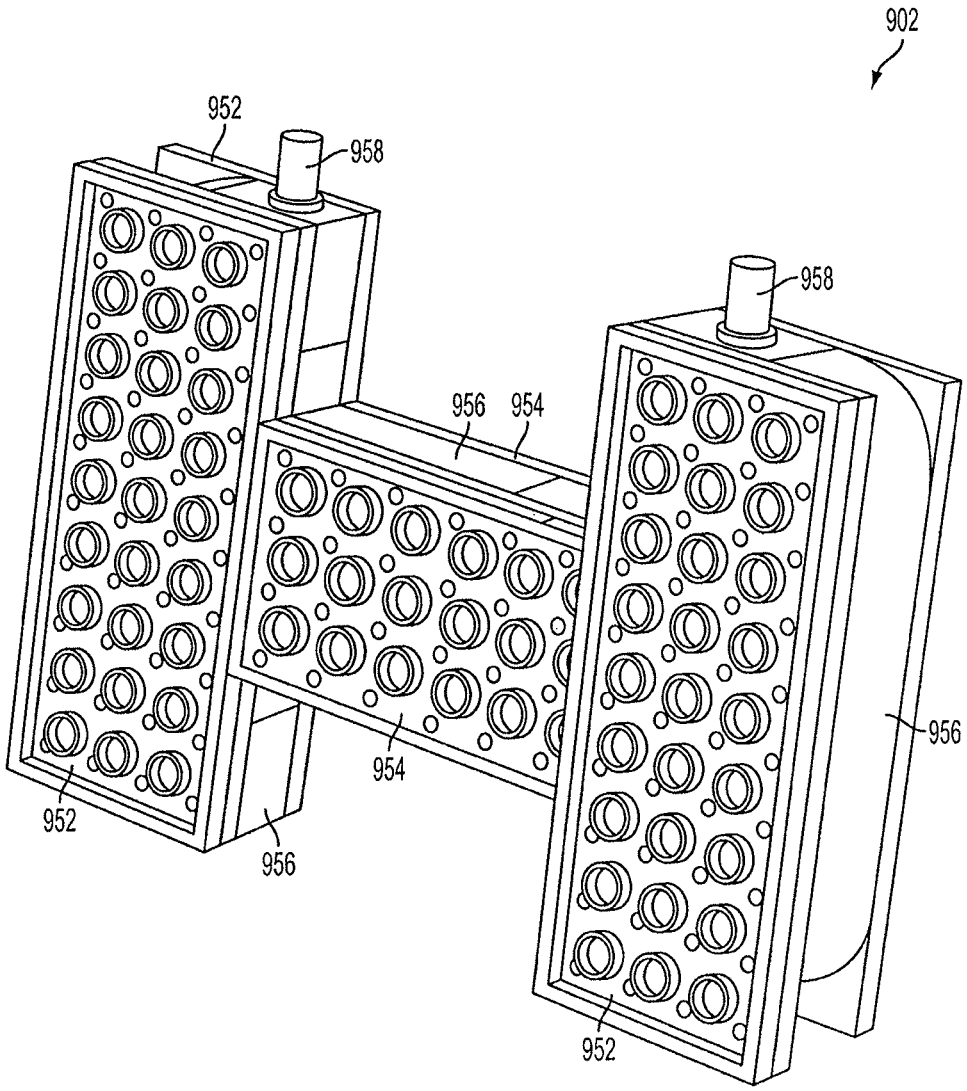
FIG. 9 depicts the catamaran building block assembly structure according to an embodiment of the present invention.

In one embodiment, as seen in FIG. 9, one of the structures may include a pre-configured set of smaller pieces or parts that can form the shape of a catamaran vessel. The catamaran structure 902 may be constructed using a combination of standard rectangular building blocks with varying thickness, lengths, and widths, such as blocks 952 containing 4×9 projections and making up the right and left side of the vessel, blocks 954 making up the central connection of the vessel, thicker inner blocks 956 providing weight and rigidity to the vessel, and specially configured blocks 958 which provide additional attack capabilities through extended protrusions from the structure. The catamaran structure 902 allows for greater angular momentum and spinning during competitions.

Figure 10:
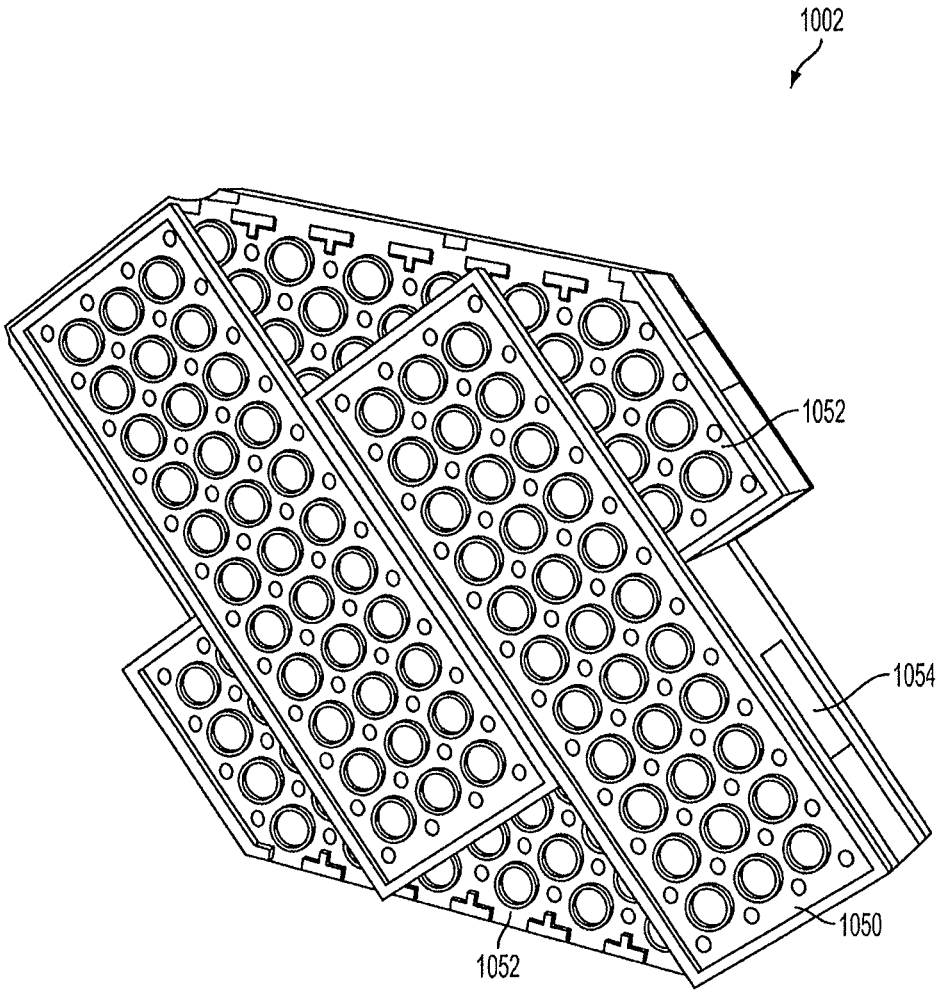
FIG. 10 depicts the crusher building block assembly structure according to an embodiment of the present invention.

In one embodiment, as seen in FIG. 10, one of the structures may include a pre-configured set of rigid square edges and angled edges to form a more efficient crushing structure during competitions. The crusher structure 1002 may be constructed using a combination of standard rectangular building blocks with varying thickness, lengths, and widths, such as blocks 1050 containing 3×11 projections, thicker inner blocks 1054 for added weight and rigidity, and specially configured angled blocks 1052 designed to provide multiple angles of attack during competitions. The crusher structure 1002 provides a mix of offensive and defensive strategy.

Figure 11:
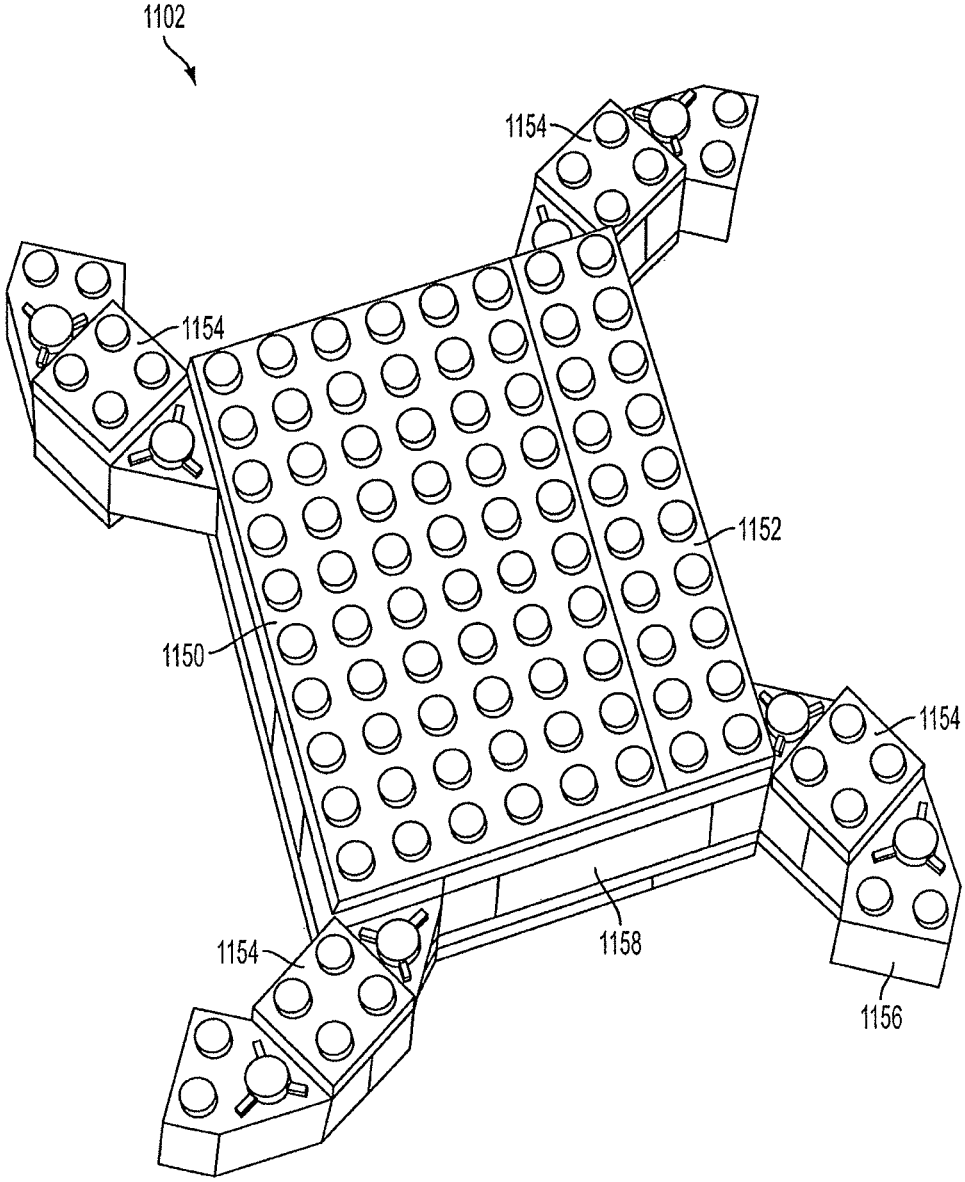
FIG. 11 depicts the spinner building block assembly structure according to an embodiment of the present invention.

In one embodiment, as seen in FIG. 11, one of the structures may include a pre-configured set of smaller pieces or parts that can form the shape of a spinning top, or spinner. The spinner structure 1102 may be constructed using a combination of standard rectangular building blocks with varying thickness, lengths, and widths, such as blocks 1150 containing 6×10 projections, blocks 1152 containing 2×10 projections, square 2×2 blocks 1154, thicker inner blocks 1158 providing weight and rigidity to the structure, and specially configured protruding arms 1156 which increase the structure's attack reach during competition.

Figure 12:
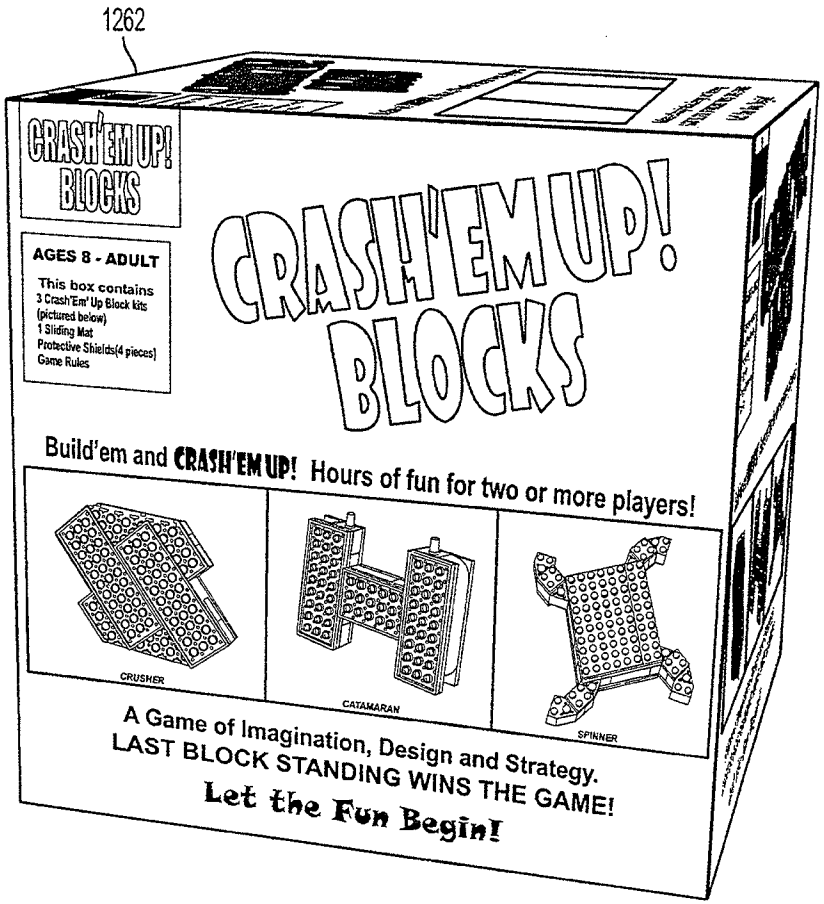
FIG. 12 depicts the individual and three block kits for the structures according to an embodiment of the present invention.
Figure 12:
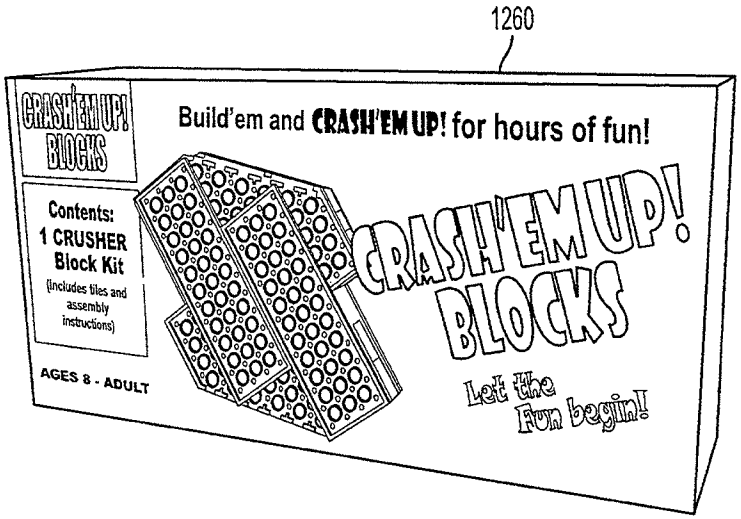
Figure 13:
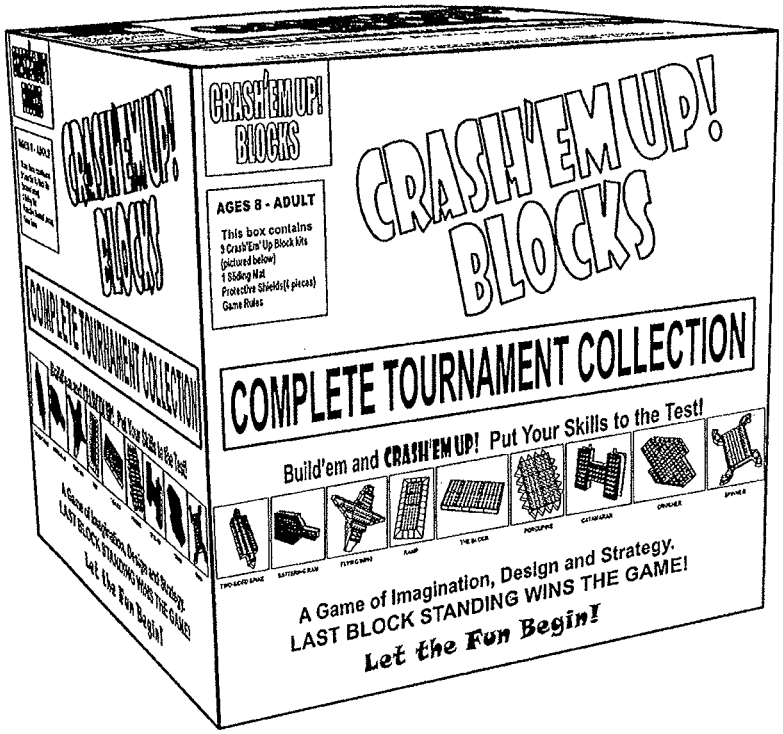
FIG. 13 depicts the complete tournament edition of the game according to an embodiment of the present invention.
Figure 13:
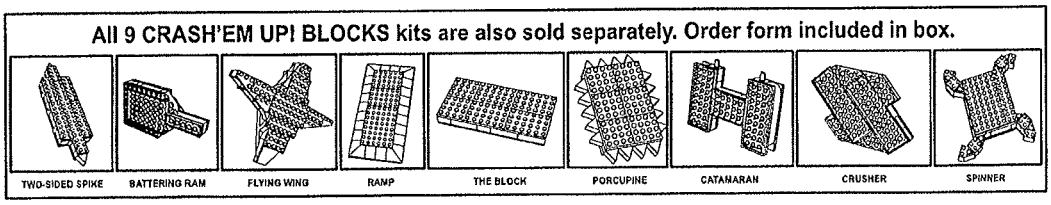

FIG. 12 depicts the structures being available in sets, or allowing the player to purchase just the structure that best supports their playing strategy. FIG. 13 depicts the entire system and structures being available via a complete tournament set.

Figure 14:
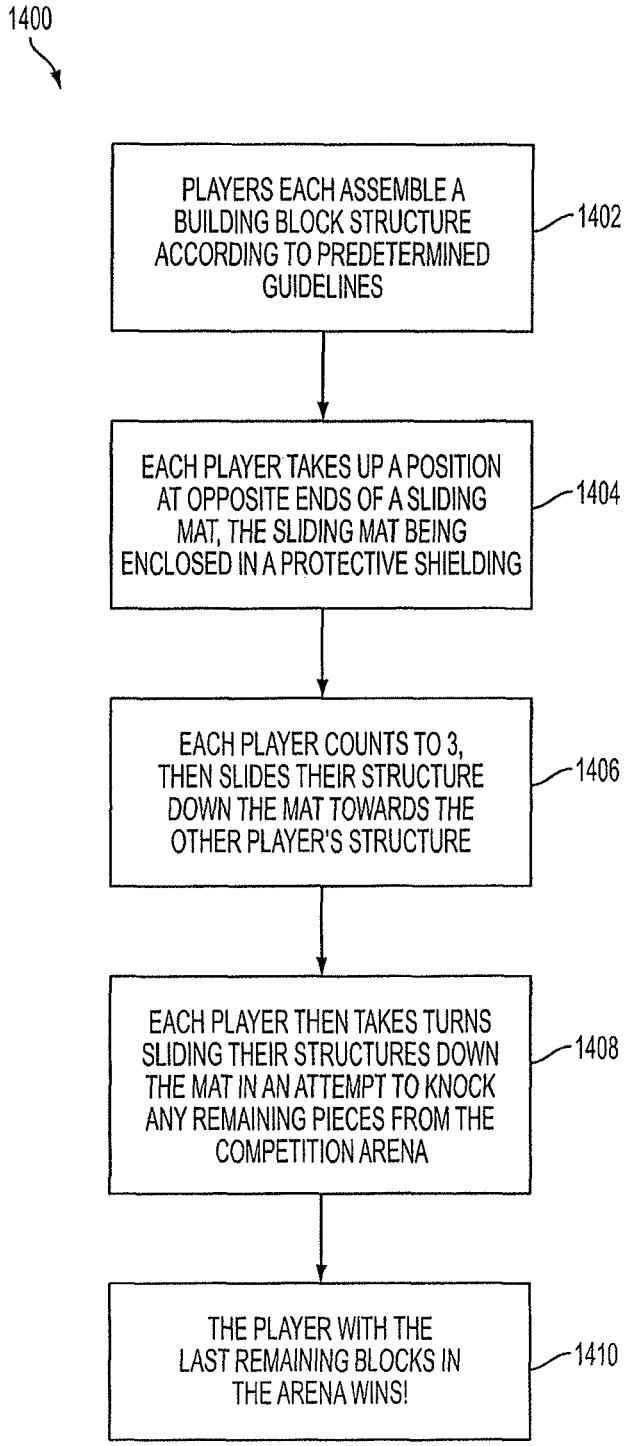
FIG. 14 represents a flow chart of the game mechanics according to an embodiment of the present invention.

FIG. 14 represents a flow chart of the game mechanics and method 1400. Players begin the game by setting up a sliding mat and a protective plastic shield. The protective plastic shield can be easily assembled by snapping all of the locking joints into place. The players can then select a competition area, such as a hallway or table, and place the mat over the desired competition area. Once the mat is in place, the players can place the protective shield over the mat and prepare their building block assembly structures for the competition.

Once the competition arena is set up, each player then assembles a building block assembly structure from smaller building block parts as described in step 1402. Each one of the structures is limited in size and shape to maintain game balance. For instance, the building block assembly structures may be limited by the number of projections each structure may have (i.e., each structure can only have 110 dots), the structures may be limited by the number of blocks being used during construction, the structures may be limited by the number of thin or thick layers it may have (i.e., each structure may only have four thin layers, two on top, and two on bottom, and one thick layer in the middle). Players may then tighten the structures before the start of the first round, but are prohibited from tightening the structures between rounds.

Once the structures have been assembled, whether from standard building block parts or preconfigured strategic kits, the players each take up positions at opposite ends of the sliding mat as described in step 1404. After counting to three (or some other agreed upon synchronous time), the players slide their building block assembly structures across the mat until they collide, ejecting any loose pieces or parts, as described in step 1406. The players then retrieve a piece of their structure from the competition arena (typically the largest remaining part of the structure within the arena) and take turns sliding the structure back down the mat, in an attempt to knock the other player's pieces or parts from the competition area, as described in step 1408. Step 1408 is repeated until only one player's blocks remain in the arena. The player with the last remaining pieces or parts on the mat wins the round, as described in step 1410.

A person of ordinary skill in the art would appreciate that the rules and guidelines of the crashing game may be varied based on competitiveness, fairness, and safety considerations. A person of ordinary skill in the art would appreciate that different combinations or sizes of building block assembly structures could be utilized to create the above mentioned building block assembly structures, and that each structure is not limited to the building block sizes and combinations disclosed.

What is claimed is:

1. A building block crashing game for crashing building block assembly structures together, comprising:

a first building block assembly structure including a first building block part removably connected to a second building block part, the first building block part and the second building block part configured to be removable from one another when a collision force applied during collision with another building block assembly structure is sufficient to remove the first building block part and the second building block part from one another;

a second building block assembly structure including a third building block part removably connected to a fourth building block part, the third building block part and the fourth building block part configured to be removable from one another upon a collision force applied during collision with another building block assembly structure that is sufficient to remove the third building block part and the fourth building block part from one another;

a sliding surface for sliding the first building block assembly structure and the second building block assembly structure towards each other on the mat in order to cause collision of the first building block assembly structure and the second building block assembly; and a protective shield having a portion positioned on or around the mat for containing the first building block assembly structure and the second building block assembly structure after the collision.

2. The building block crashing game of claim 1, wherein the protective shield includes:

two vertical parallel side walls positioned on or around the mat, and perpendicular to a surface upon which the mat is placed, and a horizontal wall positioned parallel to the surface upon which the mat is placed, and connecting the two vertical parallel side walls such that the protective shield forms a protective tunnel.

3. The building block crashing game of claim 2, wherein the protective shield is configured to connect lengthwise to another protective shield via connectors, thereby extending a length of the protective tunnel.

4. The building block crashing game of claim 1, wherein the first building block part includes an outward tubular projection, and the second building block part includes a tubular hollow portion receiving the outward tubular projection of the first building block part.

5. The building block crashing game of claim 4, wherein the outward tubular projection of the first building block part is configured to eject out of the tubular hollow portion upon a collision force applied during collision with another building block assembly structure.

6. The building block crashing game of claim 1, wherein at least one of the first building block assembly structure or the second building block assembly structure includes additional building block parts and is preconfigured to have a nose, wings, and a tail, altogether resembling an airplane.

7. The building block crashing game of claim 1, wherein at least one of the first building block assembly structure or the second building block assembly structure includes additional building block parts and is preconfigured to have two protruding spikes.

8. The building block crashing game of claim 1, wherein at least one of the first building block assembly structure or the second building block assembly structure includes a block extended outward to form the shape of a battering ram.

9. The building block crashing game of claim 1, wherein at least one of the first building block assembly structure or the second building block assembly structure includes additional building block parts and is preconfigured to have angled edges, altogether taking the shape of a ramp.

10. The building block crashing game of claim 1, wherein at least one of the first building block assembly structure or the second building block assembly structure includes additional building block parts and is preconfigured to take the shape of a rectangular block with protruding spikes around edges of the rectangular block, altogether taking the shape of a porcupine.

11. The building block crashing game of claim 1, wherein at least one of the first building block assembly structure or the second building block assembly structure includes additional building block parts and is preconfigured to take the shape of a rectangular block with protruding arms from each of four corners of the rectangular block, allowing for a greater area for applying contact force during gameplay.

12. The building block crashing game of claim 1, wherein at least one of the first building block assembly structure or the second building block assembly structure includes two rectangular structures fitted together with a central rectangular structure, altogether taking the shape of a catamaran vessel.

13. The building block crashing game of claim 1, wherein at least one of the first building block assembly structure or the second building block assembly structure includes a combination of rigid square sides and angled sides.

14. A method for crashing building block assembly structures together, the method comprising steps of:

providing a first building block assembly structure including a first plurality of removably connected building block parts;

providing a second building block assembly structure including a second plurality of removably connected building block parts;

providing a mat for allowing sliding of building block assemblies;

providing a protective shield having a part positioned on or around the mat, the protective shield and the mat forming a tunnel; and sliding the first building block assembly structure and the second building structure towards each other on the mat and within the protective shield in order to cause collision of the first building block assembly structure and the second building block assembly structure and to cause removal or disassembly of the first plurality of removably connected building block parts and removal or disassembly of the second plurality of removably connected building block parts.

15. The method of claim 14, further comprising repeating sliding of the first building block assembly structure and the second building structure towards each other on the mat and within the protective shield in an attempt to remove or disassemble via collision any remaining first plurality of removably connected building block parts that were not disassembled or removed during previous collisions or cause removal of any remaining second plurality of removably connected building block parts that were not disassembled or removed during previous collisions.

16. The method of claim 14, wherein the steps of providing the first building block assembly structure and providing the second building block assembly structure are based on a predetermined guideline that includes a restriction on at least one of a shape, a size, or a number of projections of the first building block assembly structure or the second building block assembly structure.

17. The method of claim 14, wherein the step of sliding the first building block assembly structure and the second building structure towards each other on the mat and within the protective shield is performed such that at least one of the first building block assembly structure and the second building block assembly structure spin before collision.

18. The method of claim 14, wherein the first building block part includes an outward tubular projection, and the second building block part includes a tubular hollow portion receiving the outward tubular projection of the first building block part

19. The method of claim 14, wherein the protective shield includes:

two vertical parallel walls positioned on or around the mat, and perpendicular to a ground surface upon which the mat is placed, and a horizontal wall positioned parallel to the ground surface upon which the mat is placed, and connecting the parallel walls such that the protective shield forms a protective tunnel.

20. The method of claim 14, further comprising connecting the protective shield lengthwise to another protective shield via connectors, thereby extending a length of the protective tunnel.

* * * * *